US007646307B2

(12) United States Patent
Plocher et al.

(10) Patent No.: US 7,646,307 B2
(45) Date of Patent: Jan. 12, 2010

(54) SYSTEM AND METHODS FOR VISUALIZING THE LOCATION AND MOVEMENT OF PEOPLE IN FACILITIES

(75) Inventors: Thomas A. Plocher, Hugo, MN (US); Jeffrey M. Rye, Roseville, MN (US); Liana M. Kiff, Minnetonka, MN (US); Michelle A. Raymond, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 440 days.

(21) Appl. No.: 11/299,178

(22) Filed: Dec. 9, 2005

(65) Prior Publication Data

US 2007/0132586 A1 Jun. 14, 2007

(51) Int. Cl.
*G08B 23/00* (2006.01)

(52) U.S. Cl. ..... 340/573.1; 340/573.3; 340/572.1

(58) Field of Classification Search ..... 340/573.1, 340/573.4, 573.5, 573.7, 572.1, 572.8, 568.1, 340/539.11, 539.13, 539.16; 235/385; 726/9; 705/2; 700/90; 463/29
See application file for complete search history.

(56) References Cited

U.S. PATENT DOCUMENTS 6,700,966 B2 * 3/2004 Takagi et al. ..... 379/201.06
6,839,027 B2 * 1/2005 Krumm et al. ..... 342/465
7,167,094 B2 * 1/2007 Ciarcia et al. ..... 340/568.1
7,242,306 B2 * 7/2007 Wildman et al. ..... 340/573.1
7,295,114 B1 * 11/2007 Drzaic et al. ..... 340/572.1
2004/0140899 A1 * 7/2004 Bouressa ..... 340/573.1
2004/0229560 A1 11/2004 Maloney
2005/0035862 A1 2/2005 Wildman
2006/0185005 A1 * 8/2006 Graves et al. ..... 726/9
2006/0252530 A1 * 11/2006 Oberberger et al. ..... 463/29
2007/0094046 A1 * 4/2007 Cobbs et al. ..... 705/2

FOREIGN PATENT DOCUMENTS

EP 0 602 459 A2 6/1994
GB 2 265 038 A 9/1993
WO WO 02/075352 A1 9/2002
WO WO 03/090174 A1 10/2003

* cited by examiner

*Primary Examiner*—Van T. Trieu
(74) *Attorney, Agent, or Firm*—Kris T. Fredrick; Kermit D. Lopez; William B. Shelby

(57) ABSTRACT

A system and method for visualizing the location and movement of people in facilities. The facility is provided with a plurality of sensors such as RF or IR sensors that communicate with a badge worn by each individual and selected physical assets in the facility. The sensors send data to a processor which displays the data on a monitor in a form that permits ready visualization of the individuals, and allows the observer to select information as needed. The display may directly indicate certain specifics about an individual based on data stored in the processor or entered by the observer.

22 Claims, 9 Drawing Sheets

SYSTEM AND METHODS FOR VISUALIZING THE LOCATION AND MOVEMENT OF PEOPLE IN FACILITIES

FIELD OF THE INVENTION

The present invention relates to a system and method for monitoring persons in a facility. More particularly, the invention relates to a system and method for visualizing the location and movement of individuals within the facility.

BACKGROUND OF THE INVENTION

As concerns for care of patients and residents of facilities such as hospitals, nursing homes, assisted living and community living centers increases, it is becoming more and more important to have a safe and simple method for monitoring the location of each individual in the facility. These types of facilities have a need to know the location and movement of occupants both for safety and health care reasons. Among safety concerns is the need to identity occupants who have wandered into restricted or unsafe areas in or even outside the facility. This need is complicated by the fact that different occupants may often have different access opportunities and restrictions.

In an emergency, such as a fire, there is obviously a vital need to locate all occupants who have not evacuated the facility and remain inside. Such failures to leave occur due to poor hearing, poor mobility, or cognitive impairment in elderly occupants.

On the heath care side, a location system would provide valuable information about a patient, including lack of activity over a period of time. It would also be a benefit to monitor a person's activity over a period of time, as well as identifying which locations in the facility his or her activity occurred. Care also would benefit from knowing the locations of care facility nursing staff. For billing and liability reasons, it would be useful to the facility administrator to know if a nurse or aide indeed was with a patient in a particular location at a particular time. It would also be helpful if physical assets such as, for example, critical equipment like defibrillators were tracked and displayed and thus located by persons attempting to respond to a situation.

Up to now, this information has not been available in a manner which would allow care providers or other facility operators to visualize the location information and quickly understand its meaning.

It would be of great advantage in the art if system and method could be provided that gave a visualization of each person within a facility.

Another advantage would be if a system and method could use infrared and radio frequency sensing technologies to provide data for visualization of individuals associated with the sensors.

Still another advantage would be if the system and method permitted visualization in two dimension on a monitor screen and would also permit visualization in three dimensions on the screen, as needed.

It would be yet another advance if individual areas such as specific floors in a facility could be selectively monitored by a care provider or other location operators.

Other advantages will appear hereinafter.

SUMMARY OF THE INVENTION

It has now been discovered that the above and other advantages of the present invention may be obtained in the following manner. Specifically, the present invention provides a system and method for visualizing the location and movement of individuals in a facility. Included in the system and method are a plurality of sensors located a plurality of locations in a facility and positioned to interact with persons at any location.

A badge is carried or worn by selected individuals using the facility. The badge is interactive with the plurality of sensors in a conventional manner. Preferred sensors are RF and IR sensors.

The information detected by the sensors is sent to a processor adapted to receive signals from the plurality of sensors to create display signals. These display signals are representative of interaction between the plurality of sensors and each badge being carried in the facility. The display signal may indicate identity, activity or condition of the person wearing or carrying the badge. The processor is able to create the display signals and can store them for use at other times or as an archive.

A monitor is used for displaying the display signals for visualization by an observer located in a place in the facility or at a remote location where he or she can issue commands, control access to doors, summons aid or assistance, and direct others to specific locations where the selected individual happens to be.

BRIEF DESCRIPTION OF THE DRAWINGS

For a more complete understanding of the invention, reference is hereby made to the drawings, in which.

DETAILED DESCRIPTION OF THE PREFERRED EMBODIMENT

The present invention provides for graphical representations of selected occupants in a facility in the form of a visualization framework that places graphical objects representing those occupants and their locations on two dimensional (2D) and three dimensional (3D) graphical models of the facility. The present invention is designed for a wide variety of facilities such as, but not limited to, nursing homes, hospitals, assisted living and community living sensors, and is also applicable to prisons, particularly those with less than maximum security demands, camps, schools and the like. Also within the scope of this invention is tracking and displaying the locations of various physical assents, such as, by way of example and not of limitation, critical equipment like defibrillators, oxygen masks, and the like. The present invention provides spatial context for the location information, relieving the user of a difficult spatial integration task.

Figure 1:
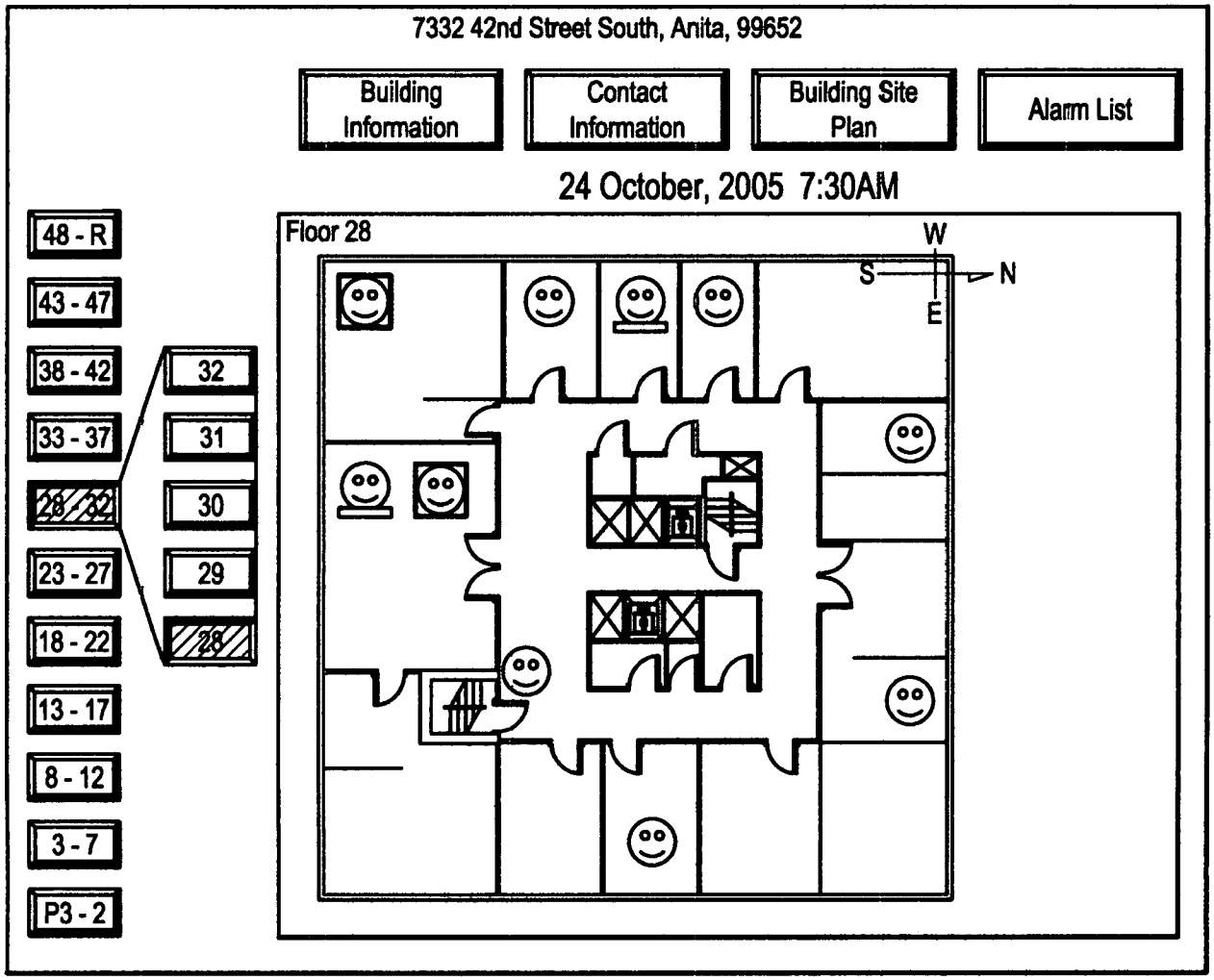
FIG. 1 is a pictorial representation of the present invention.
Figure 2:
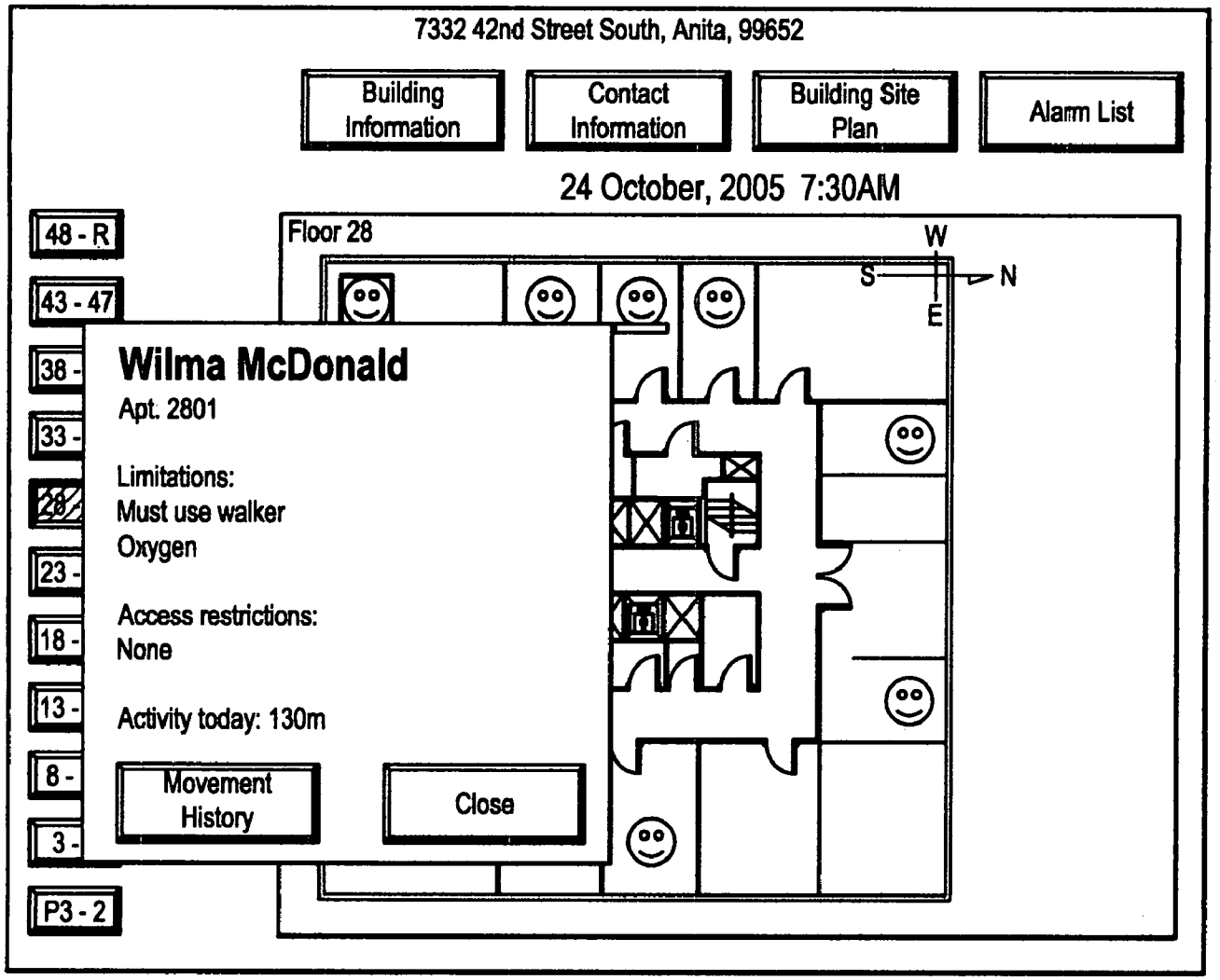
FIG. 2 is a pictorial representation similar to FIG. 1 in which information about one individual is displayed.
Figure 3:
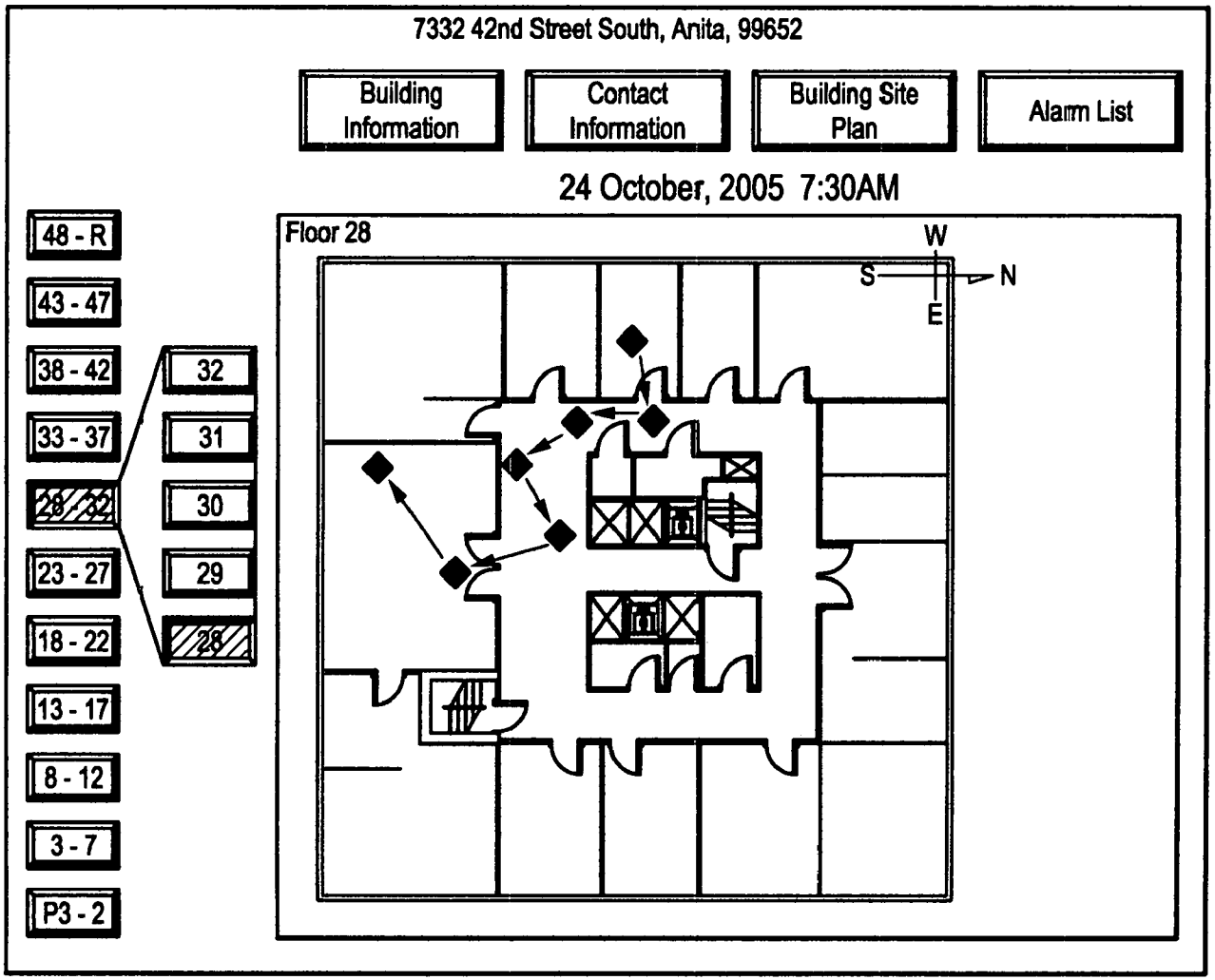
FIG. 3 is a pictorial representation of the movement of a specific individual over a period of time.

FIG. 1 represents an embodiment in which the basic display shows the most recent locations of patients and assets detected by the location system. The individuals and assets are given badges that communicate with sensors in the facility. By the term "badge" is meant any device that can communicate with a sensor to provide information such as identity, movement and the like as described herein. The individuals have different mobility levels in FIG. 1, such as those who can walk unassisted, those using a walker, and those using or requiring a wheelchair. The operator selects the floor range, then the specific floor of the facility, in this case selecting floor 28. The date and time is also shown. The operator can click on any graphical object representing an occupant and retrieve information about that occupant. The individuals wear Different files store building information, contact information, a building site plan, and an alarm list. In FIG. 2, the operator has clicked on or selected one individual as illustrated. In FIG. 3, a single occupant has been selected and the location and movement history is replayed in time compressed animation on the display monitor. The ability to replay the location history of an individual person, e.g., the movement path, for a specific time specified by the operator is useful. The history is displayed in time compressed animation, where the time intervals between reported locations along the occupant's path of movement would be "compressed" and reduced in a proportional manner to very short values, such as less than one second. When replayed with these compressed time intervals, this results in greatly speeded up sequential display of movement. This enhances the operator's perception of motion and direction over time. User controls are provided to stop, start, and go backward or forward in the time compressed animation display. The total distance and time spent moving can also be displayed.

Figure 4:
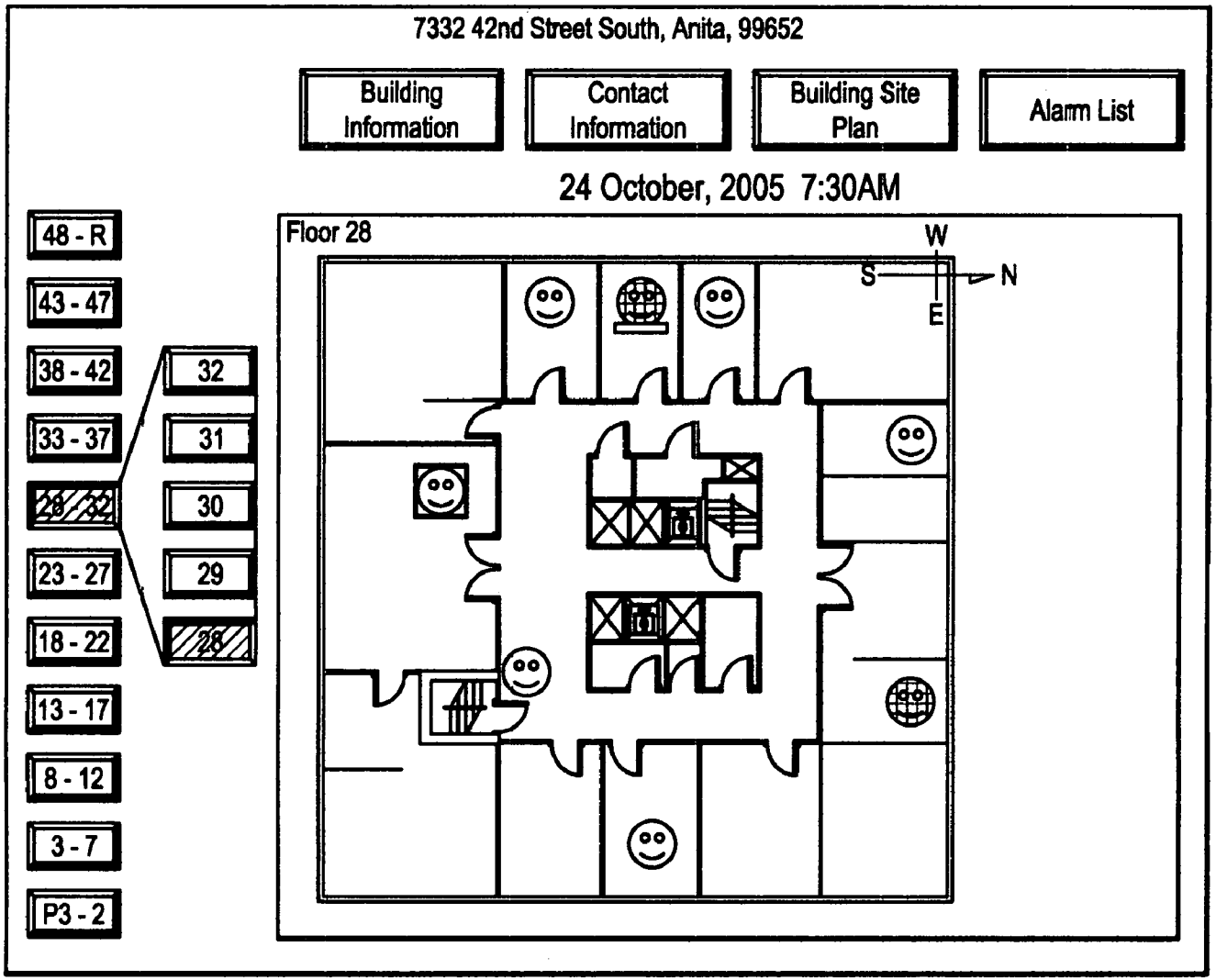
FIG. 4 is a pictorial representation of a situation where several individuals have not moved for a period of time.

FIG. 4 illustrates the ability to locate the last known position of a person and highlight lack of movement during a specific or predetermined period of time. This lack of movement is often an indication of a health problem in a facility occupant or possibly an incapacitating fall. This is critical information for the nursing staff. Icons representing occupants showing lack of movement can be highlighted, such as change in color or facial representation, to call the attention of the staff to this individual.

Figure 5:
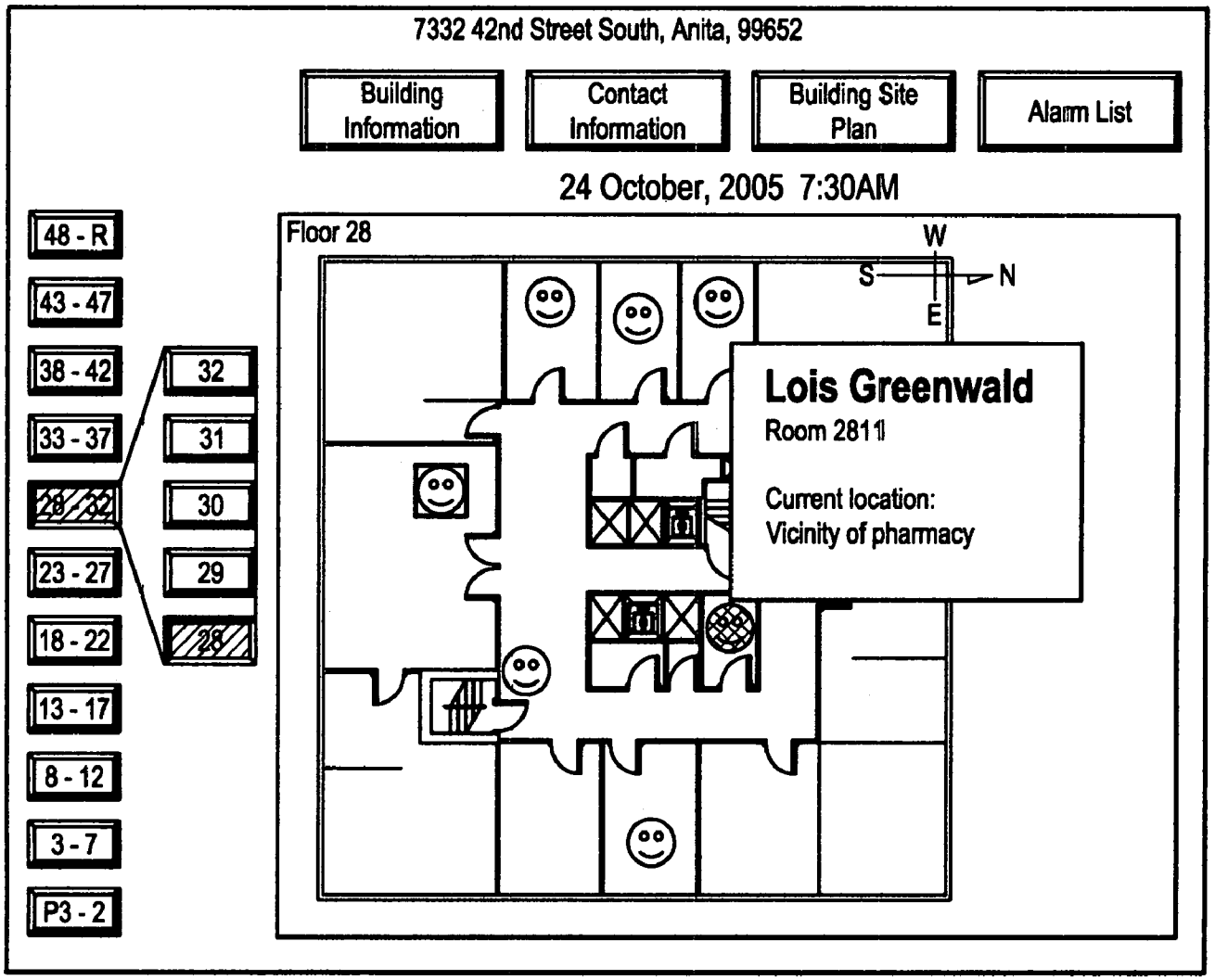
FIG. 5 is a pictorial representation of an individual who as entered an area proximate a restricted area.

FIG. 5 illustrates the situation when an occupant has wandered into a restricted area, such as the pharmacy, and the person in that area is identified along with her location. Ad aide can be dispatched to investigate. Wandering by occupants with dementia is a major concern in care facilities and the icons can readily be highlighted when one or more occupants wander beyond their allowed boundaries. The nursing station can then be alerted.

Figure 6:
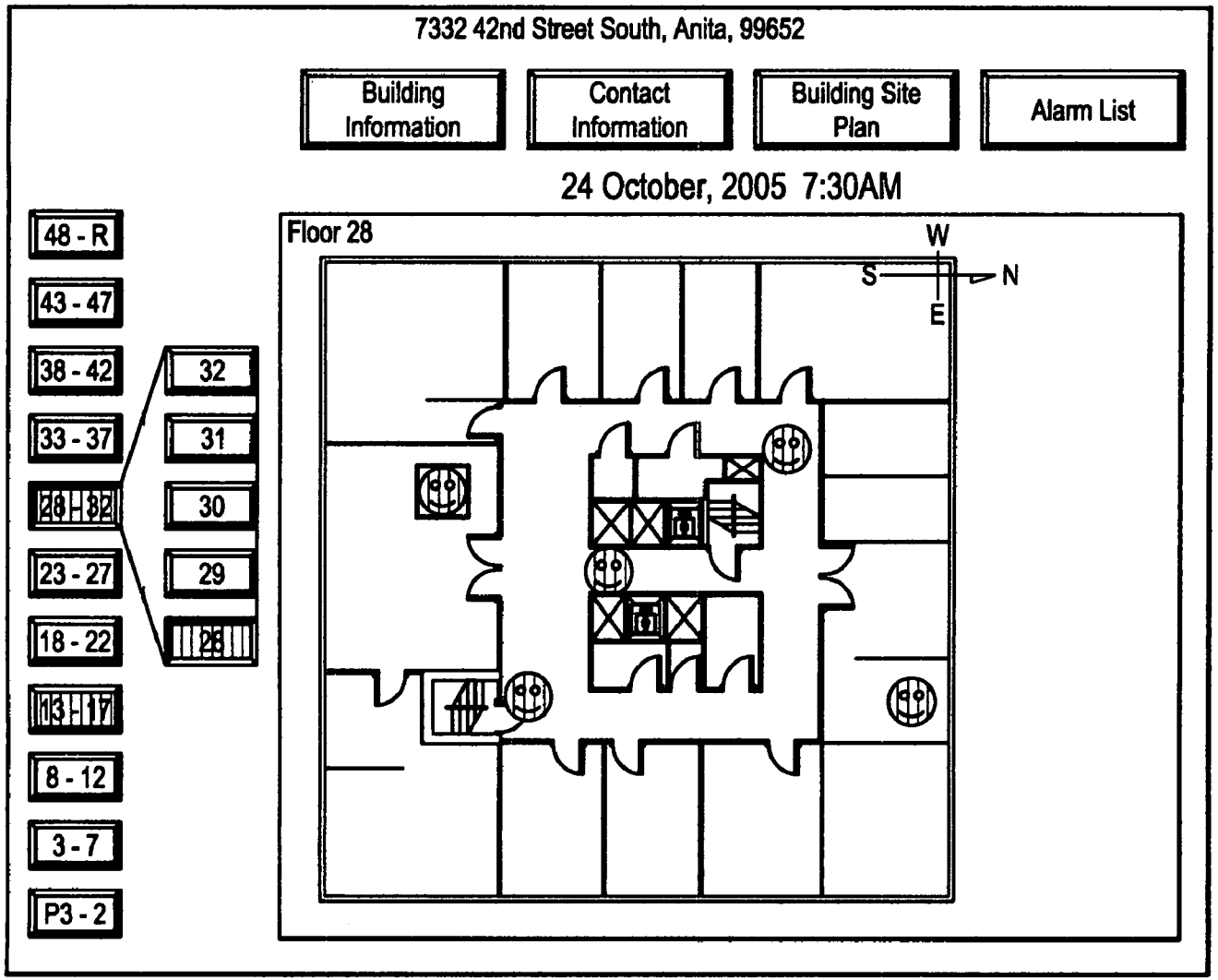
FIG. 6 is a pictorial representation of the location of a plurality of individuals when evacuation is needed.
Figure 7:
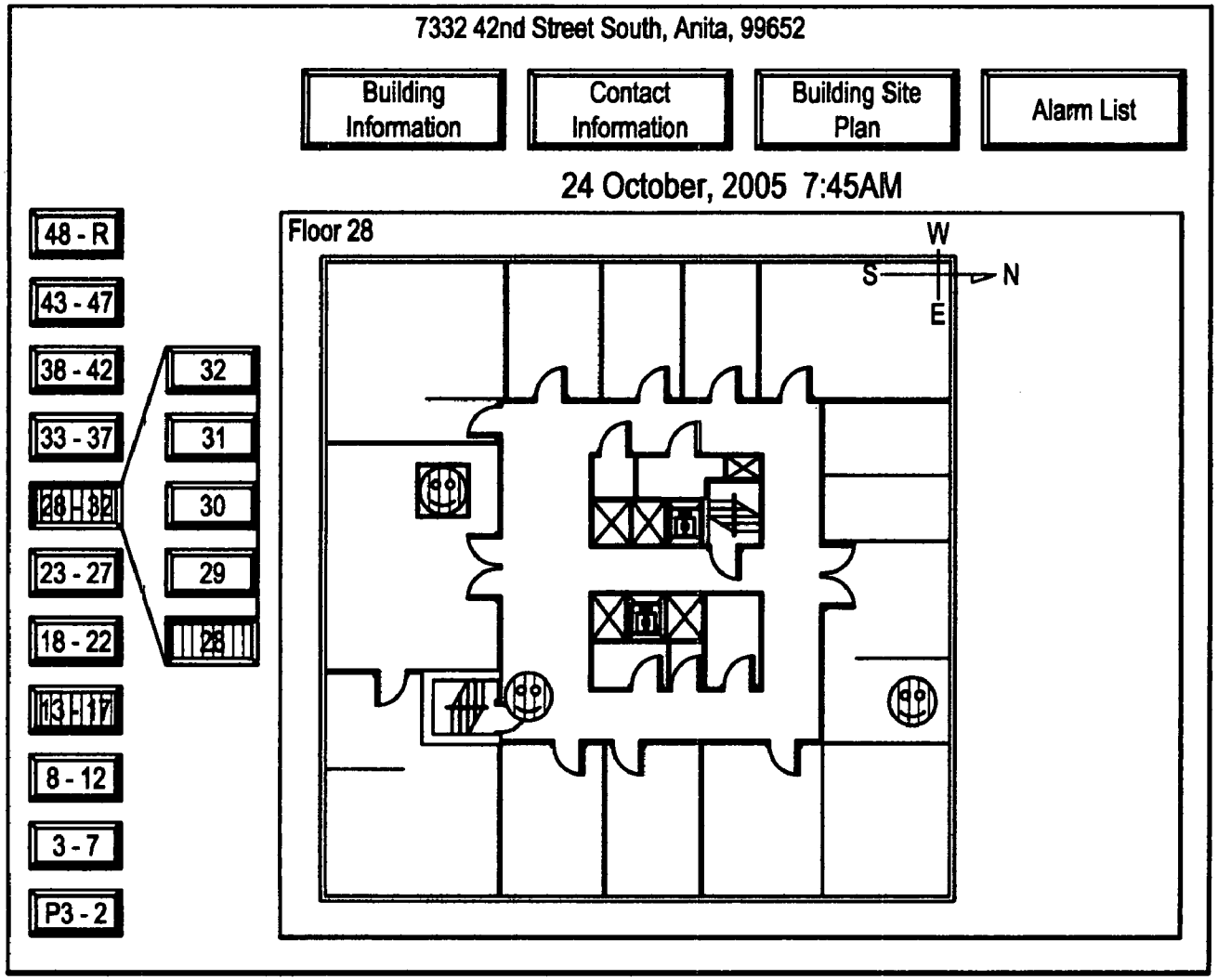
FIG. 7 is a pictorial representation of the progress of evacuation of the situation in FIG. 6.
Figure 8:
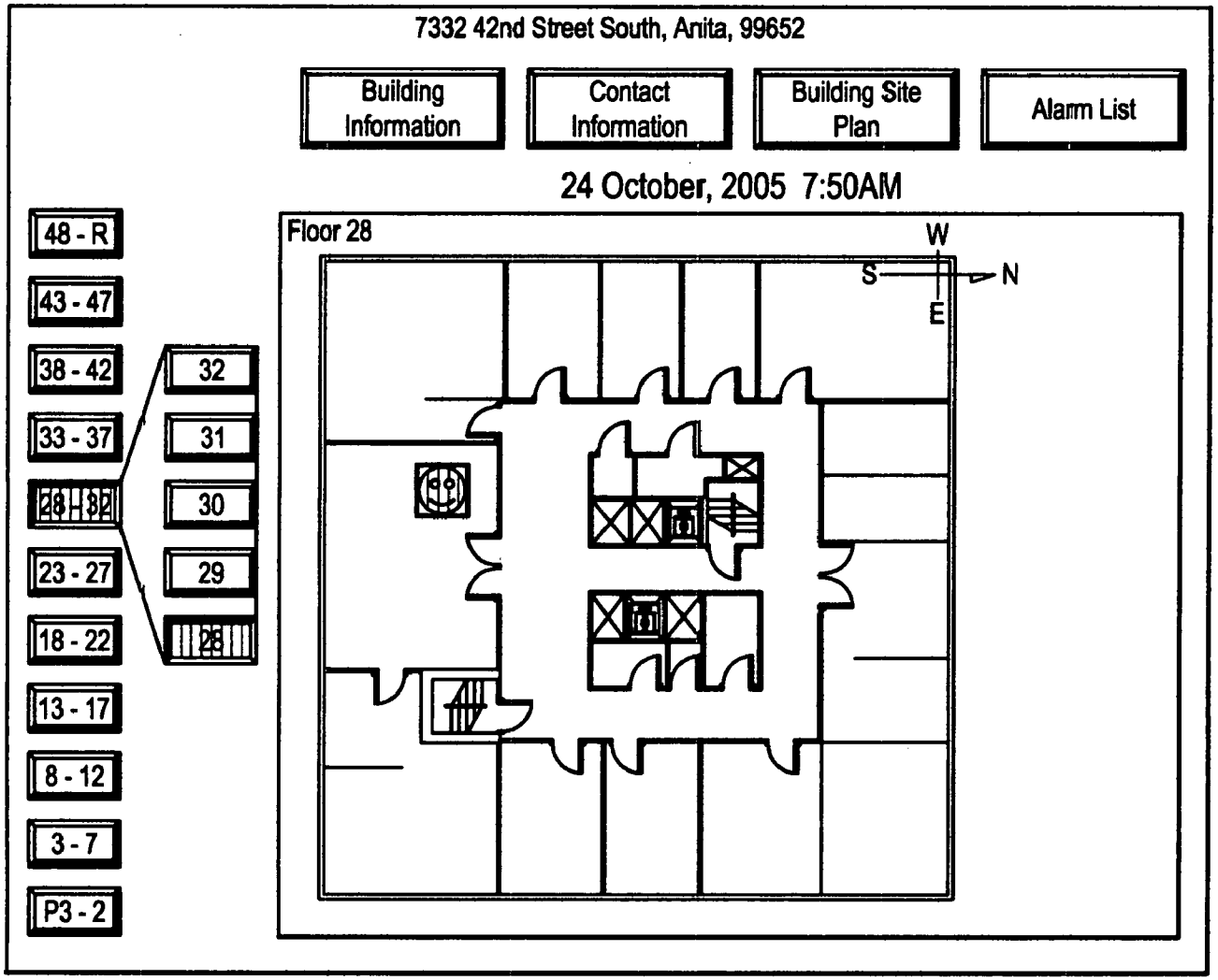
FIG. 8 is a pictorial representation of a single individual in FIG. 6 and & who has not evacuated.

In the event of an emergency requiring the occupants to evacuate or move to a new location, an alarm is sounded. FIG. 6 illustrates an emergency evacuation that proceeds, and locations where an occupant has remained in the facility are highlighted. Navigation buttons on the left of FIG. 6 indicate where occupants still remain in the facility. Shown in FIG. 6 are occupants on floor 28 and somewhere in the floor 13-17 range. Often it is merely a situation where the occupants are hearing impaired and do not hear the alarm. Others simply lack the required mobility to escape quickly. Some others may not comprehend the order to evacuate, either because of lack of cognitive ability or because of medication effects. FIG. 7 illustrates some progress being made in that fewer evacuees are on the $28^{th}$ floor. FIG. 7 also illustrates that some persons remain on floors 13-17, so the operator can change the monitor to that set of floors, then look at each individual floor as needed. In FIG. 8, the monitor shows that floors 13-17 are now clear and one person remains on floor 28. The monitor also displays that the person is wheelchair bound and most probably needs assistance. Algorithms to understand and process these situations may be integrated with this system to raise very specific alarms to human operators.

Figure 9:
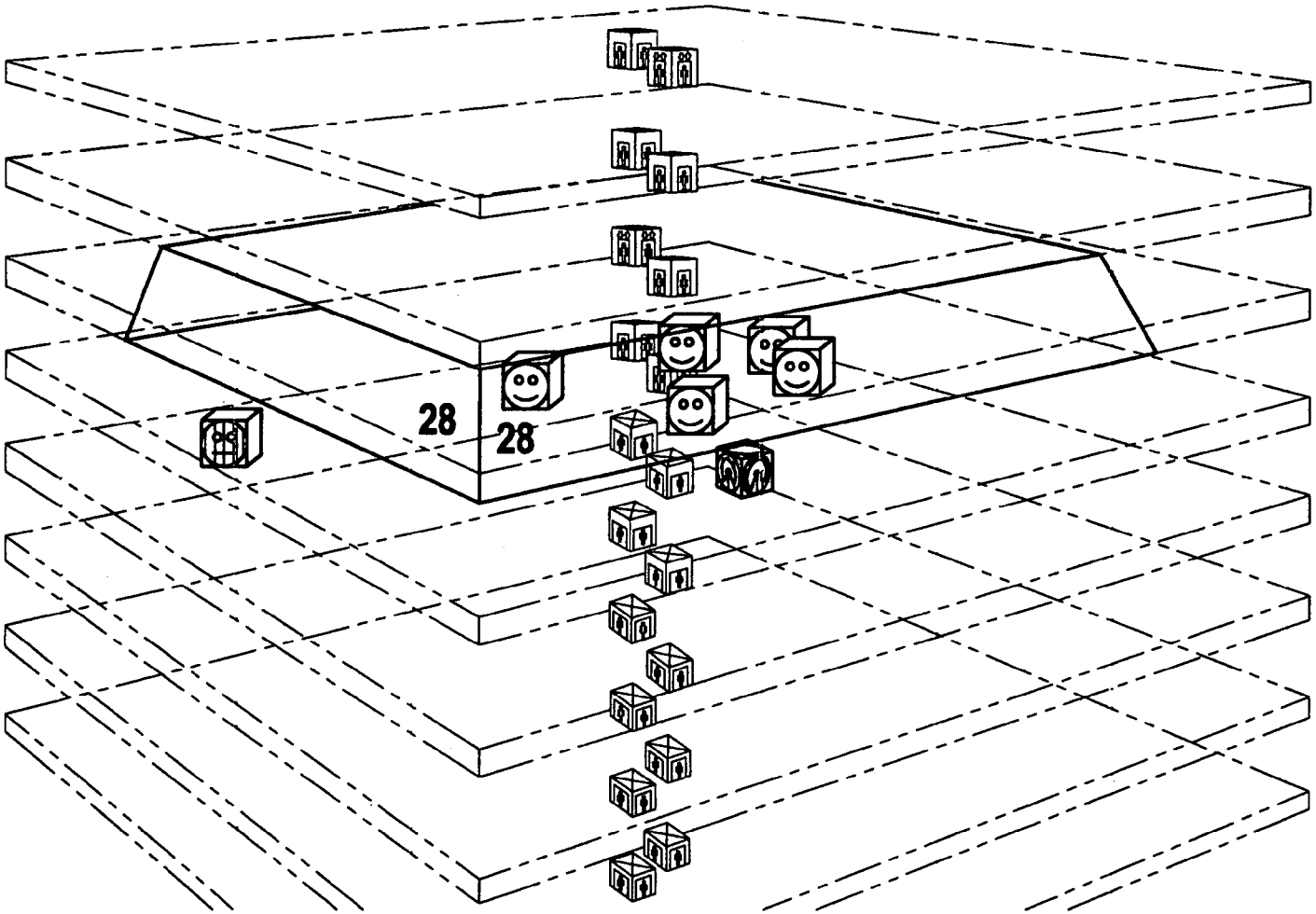
FIG. 9 is a pictorial representation indicating that an individual has moved to another floor in the facility.

The forgoing examples have been in 2D. FIG. 9 illustrates a 3d display on the monitor that allows viewing multiple floors at one time and provides a quick view, revealing in this case that someone has wandered or walked off of floor 28 and on to an adjacent floor. If that is permitted, nothing needs to be done but if that is of concern, an aide can be dispatched.

While particular embodiments of the present invention have been illustrated and described, it is not intended to limit the invention, except as defined by the following claims.

The invention claimed is:

1. A system for visualizing the location and movement of individuals in a facility, comprising:

a plurality of sensors located at a plurality of locations in and around a facility;

a badge to be carried by each selected individual of a plurality of selected individuals using said facility and attached to a plurality of physical assets in said facility, said badge being interactive with said plurality of sensors;

a processor adapted to receive signals from said plurality of sensors to create display signals representative of interaction between said plurality of sensors and each badge in said facility; and a monitor for displaying said display signals as a plurality of graphical objects on a graphical representation of at least one floor of said facility for visualization by an observer wherein each graphical object among said plurality of graphical objects graphically illustrates a mobility level of said each selected individual and is selectable via said monitor and indicates a location of said each selected individual of said plurality of selected individuals or each physical asset of said plurality of physical assets on said graphical representation of at least one floor of said facility.

2. The system of claim 1, wherein an alert is displayed on said monitor if any selected individual of said plurality of selected individuals enters a restricted area of said facility.

3. The system of claim 1, wherein said graphical representation of at least one floor includes a selectable area in order to select another floor of a plurality of floors of said facility for visualization by said observer.

4. The system of claim 1, wherein said graphical objects illustrate the movement of at least one selected individual of said plurality of selected individuals over a period of time by the selection of a selectable area on said graphical representation.

5. The system of claim 1, wherein a highlighted graphical object illustrates a lack of movement by said at least one selected individual of said plurality of selected individuals over a period of time.

6. The system of claim 1, wherein said graphical objects illustrate responses by said at least one selected individual of said a plurality of selected individuals to an alarm over a period of time.

7. The device of claim 1, wherein said graphical representation of said at least one floor is displayed in two dimensional space on said monitor.

8. The device of claim 1, wherein said graphical representation of said at least one floor comprises a graphical representation of a plurality of floors of said facility displayed in perspective three dimensional space on said monitor.

9. The device of claim 1, wherein said processor is adapted to redisplay said graphical objects on demand of the activity of said selected individuals over a period of time.

10. The device of claim 1, wherein said processor is adapted to display additional information about said at least one selected individual of said plurality of selected individuals by a selection of a graphical object representing said at least one selected individual.

11. The device of claim 1, wherein said graphical representation of at least one floor includes a graphical representation indicating any floor of said at least one floor wherein any selected individual of said selected individuals remains during an emergency evacuation of said facility.

12. A method for visualizing the location and movement of individuals in a facility, comprising the steps of:

locating a plurality of sensors a plurality of locations in and around a facility;

providing a badge to be carried by each selected individual of a plurality of selected individuals using said facility and attached to a plurality of physical assets in the facility, said badge being interactive with said plurality of sensors;

processing signals from said plurality of sensors to create display signals representative of interaction between said plurality of sensors and each badge in said facility; and displaying said display signals as a plurality of graphical objects on a graphical representation of at least one floor of said facility for visualization by an observer wherein each graphical object of said plurality of graphical objects graphically illustrates a mobility level of said each selected individual and is selectable on said monitor and indicates a location of said each selected individual of said plurality of selected individuals or each physical asset of said plurality of physical assets on said graphical representation of at least one floor of said facility.

13. The method of claim 12, wherein an alert is displayed on said monitor if any selected individual of said plurality of selected individuals enters a restricted area of said facility.

14. The method of claim 12, wherein said graphical representation of at least one floor includes a selectable area in order to select another floor of a plurality of floors of said facility for visualization by said observer.

15. The method of claim 12, wherein graphical objects illustrate the movement of at least one selected individual of said plurality of selected individuals over a period of time by the selection of a selectable area on said graphical representation.

16. The method of claim 12, wherein a highlighted graphical object illustrates a lack of movement by said at least one selected individual of said plurality of selected individuals over a period of time.

17. The method of claim 12, wherein said graphical objects illustrate responses by said at least one selected individual of said a plurality of selected individuals to an alarm over a period of time.

18. The method of claim 12, wherein said graphical representation of said at least one floor is displayed in two dimensional space on said monitor.

19. The method of claim 12, wherein said graphical representation of said at least one floor is a graphical representation of a plurality of floors of said facility displayed in perspective three dimensional space on said monitor.

20. The method of claim 12, wherein said processor is adapted to redisplay said graphical objects on demand of the activity of said selected individuals over a period of time.

21. The method of claim 12, wherein said processor is adapted to display additional information about said at least one selected individual of said plurality of selected individuals by a selection of a graphical object representing said at least one selected individual.

22. The method of claim 12, wherein said graphical representation of at least one floor includes a graphical representation indicating any floor of said at least one floor wherein any selected individual of said selected individuals remains during an emergency evacuation of said facility.

* * * * *